US008809242B2

(12) United States Patent
Takano et al.

(10) Patent No.: US 8,809,242 B2
(45) Date of Patent: Aug. 19, 2014

(54) LUBRICANT MEMBER AND METHOD OF MANUFACTURING THE SAME

(75) Inventors: Eiji Takano, Ota (JP); Yoshio Miyazawa, Ota (JP); Kazuo Negishi, Ota (JP)

(73) Assignee: Takano Co., Ltd., Ota (JP)

( * ) Notice: Subject to any disclaimer, the term of this patent is extended or adjusted under 35 U.S.C. 154(b) by 114 days.

(21) Appl. No.: 13/280,058

(22) Filed: Oct. 24, 2011

(65) Prior Publication Data

US 2012/0108474 A1 May 3, 2012

(30) Foreign Application Priority Data

Oct. 27, 2010 (JP) ..... 2010-241371

(51) Int. Cl.
*F16C 33/20* (2006.01)

(52) U.S. Cl.
USPC ..... 508/100

(58) Field of Classification Search
USPC ..... 508/100
See application file for complete search history.

(56) References Cited

U.S. PATENT DOCUMENTS

| | | | | |
|---|---|---|---|---|
| 6,377,770 | B1 * | 4/2002 | Hirose et al. | 399/286 |
| 2008/0220997 | A1 * | 9/2008 | Eadie et al. | 508/113 |

FOREIGN PATENT DOCUMENTS

| | | |
|---|---|---|
| CN | 1154383 | 7/1997 |
| EP | 2 060 620 | 5/2009 |
| JP | 63-72741 | 4/1988 |
| JP | 5-80940 | 4/1993 |
| JP | 7-118684 | 5/1995 |
| JP | 9-57424 | 3/1997 |
| JP | 3618199 | 5/1998 |
| JP | 11-80558 | 3/1999 |
| JP | 2001-246625 | 9/2001 |
| JP | 2002-241779 | 8/2002 |
| JP | 2007-204756 | 8/2007 |

OTHER PUBLICATIONS

Takano, Eiji. (Jun. 2008) "Development of "Oil Stick"—Solid Lubricant for Dies and Jigs-and-Tools, which Enables Oil-Free Treatment Inside Dies," *Press Working* 46(7):7 Pages.
Extended European Search Report dated Jan. 11, 2012, directed to EP Application No. 11186935.0; 7 pages.

* cited by examiner

*Primary Examiner* — Prem C Singh
*Assistant Examiner* — Francis C Campanell
(74) *Attorney, Agent, or Firm* — Morrison & Foerster LLP

(57) ABSTRACT

A lubricant member of a preferred embodiment of the invention is formed, into a stick-shaped body longer in a lengthwise direction than in a diametrical direction, of a mixture including at least a polyamide resin as a thermoplastic resin, an ultrahigh molecular weight polyethylene, and lubricant oil. A film made mainly of the polyamide resin is formed in the outer peripheral surface of the lubricant member. At the inner side of the film, fibrous crystals of the polyamide resin and the ultrahigh molecular weight polyethylene extend in the lengthwise direction of the lubricant member, and multiple pores are formed. With this structure, the lubricant member is produced with excellent workability without sacrificing the mechanical strength and the lubricating property.

7 Claims, 6 Drawing Sheets

LUBRICANT MEMBER AND METHOD OF MANUFACTURING THE SAME

This application claims priority from Japanese Patent Application Number JP 2010-241371 filed on Oct. 27, 2010, the content of which is incorporated herein by reference in its entirety.

BACKGROUND OF THE INVENTION

1. Field of the Invention

The invention relates to a stick-shaped lubricant member that is excellent in heat resistance and that contains lubricant oil, and relates to a method of manufacturing the lubricant member.

2. Description of the Related Art

FIG. 6 shows a known example of a conventional oilless bearing. As FIG. 6 shows, an oilless bearing 21 is formed of a metal shaped like a cylinder, and multiple holes 23 are formed in the inner surface of a wall 22 of the oilless bearing 21. The holes 23 are dents not penetrating the wall 22. A column-shaped solid lubricant 24 is buried in each hole 23. The solid lubricant 24 is made mainly of a synthetic graphite material, for example, obtained by heating (graphitizing) amorphous carbon at a temperature of 2500° C. to 3000° C. As a result, the solid lubricant 24 has high heat resistance and a small coefficient of thermal expansion, and is excellent both in the thermal shock resistance and in the chemical resistance. With this structure, the oilless bearing 21 forms a coating film of the solid lubricant (graphite) between the internal surface of the wall 22 of the oilless bearing 21 and a shaft, and accordingly is usable without any oiling mechanism using bushing or the like (This technology is described, for instance, in Japanese Patent Application Publication No. Hei 9-57424, pages 4 to 6, and FIGS. 1 and 5 to 7).

FIG. 7 shows a known example of a conventional die-set in which solid lubricant is buried. As FIG. 7 shows, a die-set 31 includes a fixed die 32, a follower die 33, and a movable die 34, for example. In the portion where the fixed die 32 and the follower die 33 are slidably in contact with each other, multiple fixed holes 35 for burying are formed in the sliding surface, for example, of the fixed die 32, and solid lubricants 36 are buried in the fixed holes 35 for burying. The solid lubricants 36 are made, for example, of a baked bonding material mainly containing graphite. The top surface of each solid lubricant 36 is exposed on the sliding surface. Coating films made of the solid lubricant (graphite) are formed on both the sliding surfaces of the fixed die 32 and the follower die 33, respectively. Likewise, similar structures are formed in the sliding surfaces of the follower die 33 and the movable die 34 (This technology is described, for instance, in Japanese Patent Application Publication No. 2001-246625, pages 2 to 3, and FIGS. 1 and 2).

The structure described below is a known example of a conventional lubricant composition. The lubricant composition is formed by: polymerizing the monomer or pre-polymer of a thermosetting resin with lubricant oil, or grease containing the lubricant oil as its base oil, and a polymer with a high oil-supply capability; and then thermally hardening the resultant polymerized product. Blending ratios with respect to the total amount of lubricant oil or grease in the lubricant composition are disclosed in a way that: the amount of thermosetting resin is 10 wt % to 90 wt %, preferably 20 wt % to 50 wt %; and the amount of polymer with high oil-supply capability is approximately 5 wt % to 30 wt %, which is practically sufficient although a larger amount of blended polymer with the high oil-supply capability increases the amount of lubricant oil or grease content (This technology is described, for instance, in Japanese Patent Application Publication No. 7-118684, pages 3 to 5).

SUMMARY OF THE INVENTION

As described earlier, in the oilless bearing 21 shown in FIG. 6, multiple holes 23 are formed in the wall 22 serving as the sliding surface, and the solid lubricant 24 is buried in each hole 23. The graphite, which is the main content of the solid lubricant, coats the sliding surfaces, and keeps certain lubricating performance between the sliding members. Likewise, in the die-set 31 shown in FIG. 7, because of the use of the solid lubricant 36 made of the baked bonding material mainly containing graphite, the graphite coats the sliding surfaces, and thereby keeps the lubricating performance between the sliding members.

However, even the oilless bearing 21 and the die-set 31 have the following problems. Specifically, both of the solid lubricants 24, 36 do not contain any lubricant oil; and are so hard as to have low capability of supplying lubricant that becomes the coating film, in comparison to a case where lubricant oil or grease is supplied to the sliding surfaces. In addition, the low capability of supplying the lubricant leaves some portions of the sliding surfaces without the coating film, and these portions are likely to become seized regions, where galling takes place in some cases. Moreover, small pieces chipped off from the solid lubricants 24, 36 existing on the sliding surfaces sometimes damage the sliding surfaces.

In some case, a lubricant composition is made of a thermosetting resin to deal with the above-described problems caused by the hard solid lubricants 24, 36. The use of the thermosetting resin reduces the galling in the sliding surfaces, and increases the amount of the lubricant-oil content, in comparison to the cases of the solid lubricant 24, 36. The lubricant composition made of the thermosetting resin, however, is softer than the solid lubricants 24, 36, and pieces may possibly be chipped off from the lubricant composition while the lubricant composition is used while being exposed on the sliding surfaces, as shown in FIGS. 6 and 7. In this case, the thermosetting resin is poor in the lubricating property and chipped pieces existing on the sliding surfaces are adhered to the sliding surfaces, resulting in a problem of making a sliding property poor. In addition, if the chipped pieces are carbonized on the sliding surfaces due to the heat caused by the friction, the layer of the carbonized pieces causes a problem of damaging the sliding surfaces physically.

Last but not the least, there are industrial demands for a resin-made, heat-resistant, durable and long stick-shaped lubricant composition which contains lubricant oil, and which can be buried in holes in a sliding surface after being cut into pieces depending on the depth of the holes. Despite the demands, such a stick-shaped lubricant composition has not been produced as a product usable in a high-temperature environment. In the case of using, for example, a thermosetting resin, the molded product of lubricant composition is so hard as to have poor workability. In addition, when the lubricant composition is processed into a long stick-like shape, it is difficult to mix the lubricant oil evenly in the entire stick-shaped lubricant composition, which poses another problem that the lubricating properties differ from one cut surface to another. Moreover, forming a long stick-shaped lubricant composition itself is also difficult in some cases of particular blending ratios of raw materials and/or under certain manufacturing conditions.

The present invention has been made with the foregoing situations taken into consideration. A lubricant member of a preferred embodiment of the invention is molded, into a stick-shaped body defined by an axial direction and a radial direction, comprising: a lubricant oil; an ultrahigh molecular weight polyethylene; and a thermoplastic resin having a melting point higher than the ultrahigh molecular weight polyethylene; wherein the thermoplastic resin forms a dense and crystallized portion in a periphery of the stick-shaped body with respect to the radial direction and forms fibrous crystals in an inner portion of the stick-shaped body with respect to the radial direction so that a plurality of pores between the fibrous crystals contain the lubricant oil or crystallized bodies of the ultrahigh molecular weight polyethylene holding the lubricant oil.

A method of manufacturing a lubricant member of another preferred embodiment of the invention is characterized by including the step of: preparing a mixture comprising a granular material of an ultrahigh molecular weight polyethylene, a granular material of a thermoplastic resin having a melting point higher than the ultrahigh molecular weight polyethylene and a liquid lubricant oil; providing a die having an axial cavity defined by an axial direction and a radial direction; filling the cavity of the die with the mixture; heating the die while a pressure is applied to the mixture in the cavity in the axial direction so that the mixture reaches a temperature higher than or equal to the melting point of the thermoplastic resin; and cooling the die so as to form the mixture into a stick-shaped body.

DESCRIPTION OF THE PREFERRED EMBODIMENTS

Figure 1A:
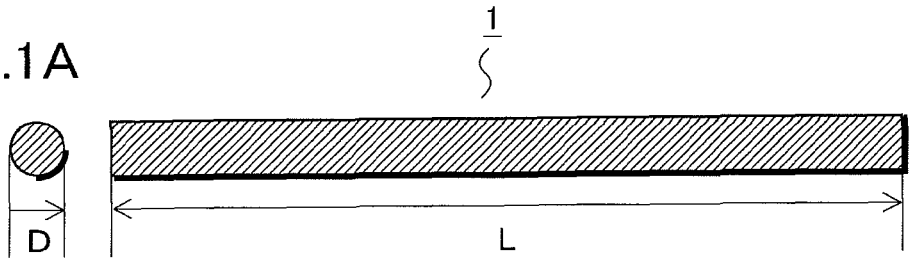
FIGS. 1A, 1B, and 1C are a sectional view, a photograph, and a schematic perspective view, respectively, to describe a lubricant member of a preferred embodiment of the invention.
Figure 1B:
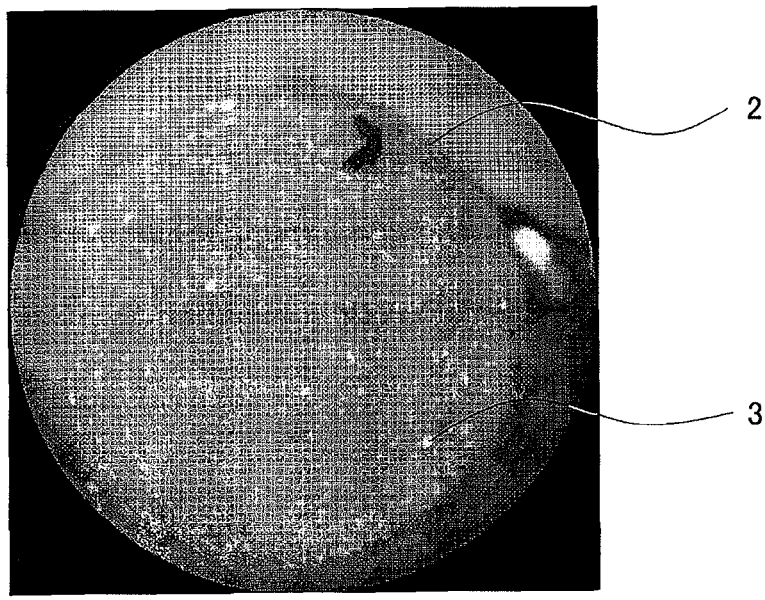
Figure 1C:
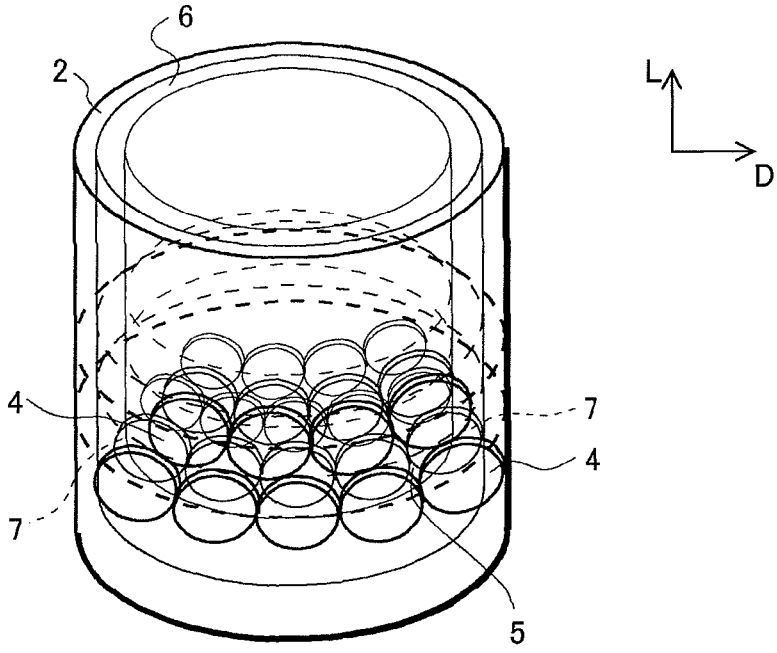

Description is given below of a lubricant member of a preferred embodiment of the invention. FIG. 1A is a sectional view to describe a lubricant member of the embodiment. FIG. 1B is a photograph taken of the lubricant member of the embodiment. FIG. 1C is a schematic view to describe the lubricant member of the embodiment. FIGS. 2A to 2E are perspective views to describe an example of how to use the lubricant member of the embodiment. FIGS. 3A to 3C and FIGS. 4A to 4C are photographs showing results of an experiment performed with the lubricant member.

As FIG. 1A shows, a lubricant member 1 is formed as a stick-shaped member longer in the lengthwise direction (L) than in the diametrical direction (D). The following description is based on an assumption that the lubricant member 1 has a columnar shape. The shape of the stick-shaped lubricant member 1, however, is not limited to a columnar one. A diametrical section may have a triangular, quadrangular, or other polygonal shape.

The lubricant member 1 is formed by: mixing, for example, at least a thermoplastic resin, an ultrahigh molecular weight polyethylene, and lubricant oil together; filling the resultant mixture in a die; heating the mixture in the die under a certain pressure; and then cooling the resultant mixture. As shown in the drawing, the lubricant member 1 is designed to be 4.2 mm to 12.2 mm in a dimension in the diametrical direction (D), and in a range of 30.0 mm to 200.0 mm in a dimension in a lengthwise direction (L). Note that the dimensions both in the diametrical direction (D) and in the lengthwise direction (L) may be changed appropriately to meet the needs of the use of the lubricant member 1.

A polyamide resin is used as the thermoplastic resin. For example, Nylon 6 (produced by Toray Industries, Inc.) or Nylon 66 (produced by Ube Industries, Ltd.) is used as the thermoplastic resin. Fine particles of Nylon 6 have an average particle size of 13 μm (TR-7) or 20 μm (TR-2). Nylon 6 has a sharp particle-size distribution and a characteristically porous structure. Nylon 6 has an excellent capability of supplying oil and is dispersed well in water. In addition, Nylon 6 is highly resistant against heat. The polyamide resin forms the skeletal structure of the lubricant member 1, and has a melting point which is as high as 230° C. to 260° C., as well as enhances the heat resistance and durability of the lubricant member 1. The lubricant member 1 thus formed is usable under a high-temperature conditions where the sliding surfaces are at 200° C. approximately. In comparison to thermosetting resins, the polyamide resin has better capability of supplying oil and thereby serves also as a lubricant without sacrificing the mechanical strength. Hence, even if pieces of polyamide resin chipped off from the lubricant member 1 exist on the sliding surfaces, the pieces do not adhere to the sliding surface, or impair the sliding property. In addition, pieces of polyamide carbonize due to the frictional heat generated by the sliding motions, so that no layer of carbonized pieces that would physically damage the sliding surfaces is formed at all. Note that other polyamide resins such as Nylon 12 and PET may also be used in place of Nylon 6 or Nylon 66.

Examples of the usable ultrahigh molecular weight polyethylene are HIZEX MILLION® (produced by Mitsui Chemicals, Inc.) and MIPERON® (produced by Mitsui Chemicals, Inc.). HIZEX MILLION® is an ultrahigh molecular weight polyethylene with an average particle size ranging of 150 μm to 200 μm, and an average molecular weight ranging from 0.5 million to 6 million. HIZEX MILLION® has excellent mechanical properties. MIPERON® is an ultrahigh molecular weight polyethylene with an average particle size ranging of 25 μm to 30 μm, and an average molecular weight ranging of 1.5 million to 3 million. MIPERON® has an excellent lubricating ability, and is well resistant to abrasion. The melting point of each ultrahigh molecular weight polyethylene is 130° C., approximately.

A mixture of poly-α-olefin and ester is used as the lubricant oil. Other possible materials used as the lubricant oil are: hydrocarbon-based ones such as α-olefin oligomer; ester-based ones such as polyphenyl ester; ester-based ones such as ethylhexyl sebacate; silicone-based ones such as polysiloxane; fluorine-based ones such as fluorocarbon. Alternatively, the lubricant member 1 may be formed by using either plant-derived lubricant oil such as olive oil or animal-derived lubricant oil such as lard. In such cases, the lubricant member 1 can be used in the sliding surfaces of various food-processing machines.

The lubricant member 1 contains various other materials including: solid lubricant such as graphite granular; graphite; and molybdenum disulfide. When these materials are mixed in the lubricant oil and coat the sliding surfaces, the sliding performance between sliding parts is improved further.

As FIG. 1B shows, the side surface of the lubricant member 1 in the diametrical direction (D) is coated with a film 2 in which mainly the polyamide resin is densely crystallized because of the difference between the melting points of the polyamide resin and the ultrahigh molecular weight polyethylene. In the portion of the member 1 at the inner side of the film 2, the polyamide resin and/or the ultrahigh molecular weight polyethylene is crystallized into a fibrous state under particular cooling conditions, and multiple pores 3 are accordingly formed among the crystal structures. The multiple pores 3 contain the lubricant oil and the ultrahigh molecular weight polyethylene in whose crystals the lubricant oil is held.

As FIG. 1C shows, the lubricant member 1 is crystallized to have multiple layers which are formed in an annual-ring-like manner from the side surface to the center of the columnar lubricant member 1 as the cooling progresses. Such annual-ring-like layers are presumably formed according to the cooling rate, by cooling a die provided with a cylindrical-shaped cavity after heating the die to raise the temperature in the die to or above the melting point of the polyamide resin, which will be described in details later. Note that each two adjacent layers are connected together by fibrous crystals of the polyamide resin and/or those of the ultrahigh molecular weight polyethylene.

To be more specific, in the layer of the film 2, multiple plate-shaped crystal layers 4, in each of which the polyamide resin is densely crystallized, are presumably crystallized adjacent to one another in the lengthwise direction of the lubricant member 1. For descriptive convenience, FIG. 1C depicts wide gaps 5 among the crystal layers 4. However, the gaps 5 are actually narrow. Fibrous crystals extending from the inner layer 6 and/or from the adjacent crystal layers 4 are presumably formed in these gaps 5. As described earlier, in the layer of the film 2, mainly the crystal layers of the densely-crystallized polyamide resin are formed due to the difference in the melting point. Hence, the layer of the film 2 has a smooth and flexible surface, and offers a function of: minimizing the leakage of the lubricant oil in the diametrical direction (D); and increasing the supply of the lubricant oil in the lengthwise direction.

Furthermore, like the layer of the film 2, the layer 6 at the inner side of the film 2 includes multiple plate-shaped crystal layers 7 which are presumably crystallized adjacent to one another in the lengthwise direction (L) of the lubricant member 1. The crystals in the crystal layers 7 are not so densely formed as those in the crystal layer 4. This is presumably because: the slower decrease in the temperature allows the chains of the ultrahigh molecular weight polyethylene to inhibit the crystallization of the polyamide resin alone; and the crystallization of the crystal layers 7 progresses while the crystals of the polyamide resin and the ultrahigh molecular weight polyethylene intertwine with each other. Consequently, a structure with multiple pores 3 formed among the crystal layers 7 is presumably formed without each of the polyamide resin and the ultrahigh molecular weight polyethylene being densely crystallized into lumps.

Though details are described later, if the heating and the cooling are performed under the conditions where a certain pressure is applied to the cylindrical-shaped cavity of the die in the lengthwise direction (L) of the cavity, the fibrous crystals of the polyamide resin and those of the ultrahigh molecular weight polyethylene extend longer in the lengthwise direction (L) of the lubricant member than in the diametrical direction (D). This structure facilitates development of each of the pores 3 formed among the fibrous crystals into a long cavity which extends longer in the lengthwise direction (L) of the lubricant member 1. Consequently, the lubricant oil held in the pores 3 has a structure allowing easy supply in the lengthwise direction (L) of the lubricant member 1.

Though not illustrated in FIG. 1C, plural heap of multiple layers are formed in an annual-ring-like manner in the portion located on the inner side of the layer 6. As in the above-described case of the crystal layers 7, in the crystal layer included in each of the multiple layers, fibrous crystals of the polyamide resin and those of the ultrahigh molecular weight polyethylene extend, intertwining with one another in the lengthwise direction (L) of the lubricant member 1, and multiple pores 3 are concurrently formed. The pores 3 hold the lubricant oil that cannot be contained in the crystals of the ultrahigh molecular weight polyethylene. When the polyamide resin and the ultrahigh molecular weight polyethylene develop into fibrous crystals, the plural pores 3 become easy to continue from one to another in the diametrical direction (D), and hence, the lubricant oil becomes able to move in the diametrical direction (D) through the pores 3. This realizes the homogeneous dispersion of the lubricant oil in the lubricant member 1.

Note that, in the crystal layers 4 and 7 formed on the inner side of the film 2, including regions which are not illustrated, multiple pores 3 may be formed among crystals through a process in which: multiple fibrous crystals develop into corrugated crystal bodies due to their connections; and the resultant crystal bodies extend longer in the lengthwise direction (L) of the lubricant member 1 than in the diametrical direction (D) of the lubricant member 1. The crystal layers included in each layer has different sizes and thicknesses in the diametrical direction (D) from one layer to another due to the different cooling speeds.

Next, an example of how to use the lubricant member 1 is described below by referring to FIG. 2A (A) to FIG. 2E.

Figure 2A:
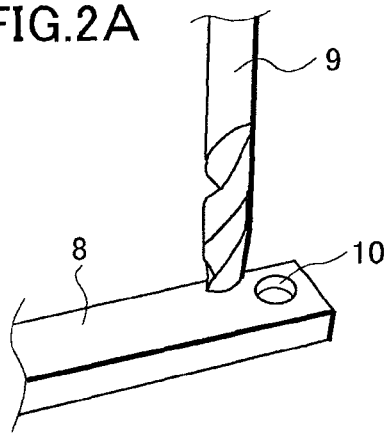
FIGS. 2A to 2E are perspective views to describe an example of how to use the lubricant member of the preferred embodiment of the invention.
Figure 2B:
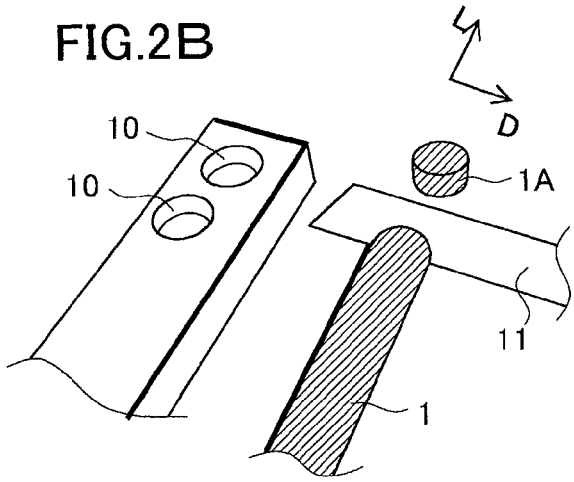
Figure 2C:
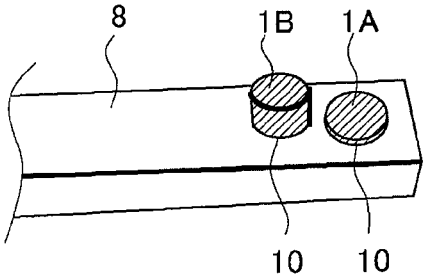
Figure 2D:
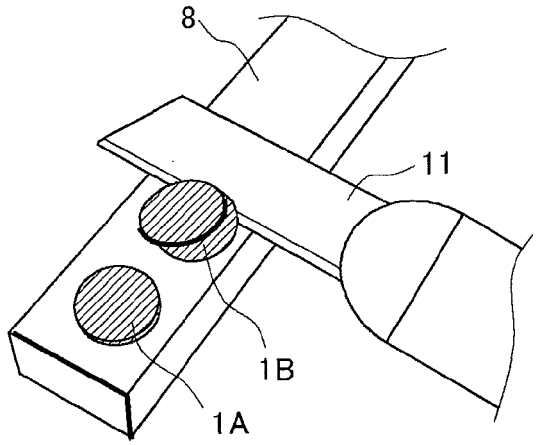
Figure 2E:
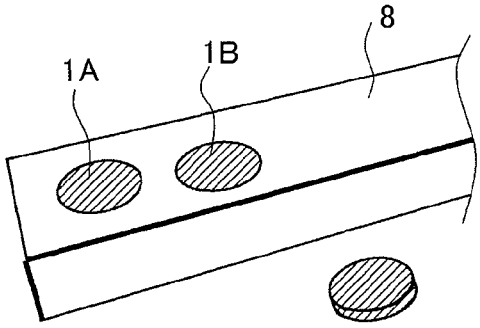

As FIG. 2A shows, column-shaped holes 10 are formed in a sliding surface of a slidable plate 8 by use of a drill 9 or something similar. Note that the forming of the holes 10 with the drill 9 or something similar may be done directly in a sliding surface of a milling machine. Then, as FIG. 2B shows, the lubricant member 1 is cut into pieces in the diametrical direction (D) with a cutter knife 11 or something similar so that each cut piece of the lubricant member 1 can be longer than the depth of the corresponding hole 10. Note that the lubricant member 1 whose size (diameter) is equal to or slightly larger than that of the holes 10 is used. Then, as FIG. 2C shows, the cut pieces 1A and 1B of the lubricant member 1 (hereinafter, also referred to as the "lubricant members 1A, 1B") are buried into the holes 10 formed in the slidable plate 8. Then, as FIG. 2D shows, portions of the lubricant members 1A, 1B which stick out from the sliding surface of the slidable plate 8 are cut away along the sliding surface of the slidable plate 8. Thus, as FIG. 2E shows, the exposed surfaces of the lubricant members 1A, 1B are made substantially flush with the sliding surface.

As described earlier, the film 2 of the lubricant member 1 is formed as a thin film without sacrificing the mechanical strength, and fibrous crystals of the polyamide resin and fibrous crystals of the ultrahigh molecular weight polyethylene extend in the in the lengthwise direction (L) of the lubricant member. Hence, it is easier to cut the lubricant member 1 in the diametrical direction (D). Furthermore, although the diametrical (D) sections of the cut-out lubricant members 1A, 1B are exposed to the sliding surface of the slidable plate 8, pores 3 containing the lubricant oil are arranged in the depth direction of the holes 10 formed in the slidable plate 8. Hence, the lubricant oil is supplied to the sliding surface gradually and slowly, and thereby each of the lubricant members 1A, 1B can have a longer service life.

In addition, since the fibrous crystals of the polyamide resin and the fibrous crystals of the ultrahigh molecular weight polyethylene extend in the lengthwise direction (L) of the lubricant member, the width of each of the fibrous and corrugated crystal bodies is smaller in the exposed surfaces of the lubricant members 1A, 1B. Hence, multiple fibrous and corrugated crystal bodies are exposed to the exposed surfaces of the lubricant members 1A, 1B, so that the contact area of these crystals with the sliding member (i.e., the counterpart of the sliding plate 8 decreases). Consequently, the lubricant members 1A, 1B can respond to the movement of the sliding member in a smooth and flexible manner, and thus the mechanical stress which the lubricant members 1A, 1B receive from the sliding member can be reduced a lot.

In addition, the columnar shape of the lubricant member 1 makes the shape of each hole 10 easier to form in the sliding surface of the slidable plate 8 with drill 9 or something similar. In addition, the workability is enhanced in fitting each cut-piece of the lubricant member 1 into the corresponding hole 10.

In addition, the inhibition of the leakage of the lubricant oil from the side surface of the lubricant member 1 provides a structure which makes the lubricant member 1 less likely to come off the holes 10.

TABLE 1

Figure 3A:
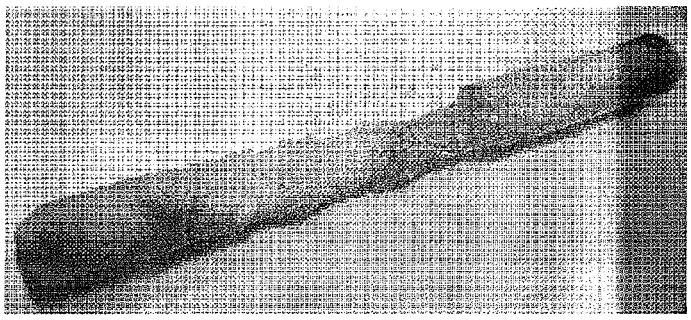
FIGS. 3A to 3C are photographs to describe an experiment performed with the lubricant member of the preferred embodiment of the invention.
Figure 3B:
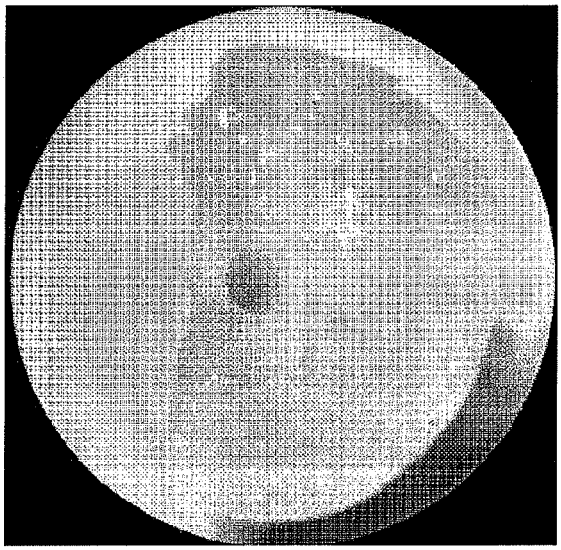
Figure 3C:
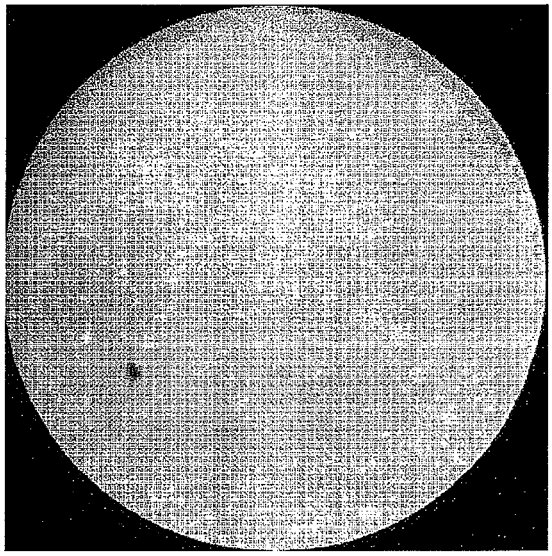
Figure 4A:
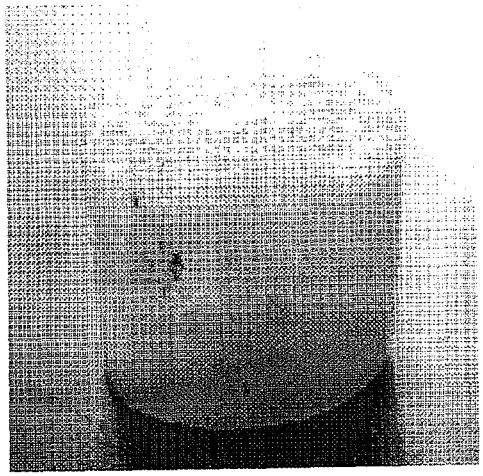
FIGS. 4A, 4B, and 4C are the other photographs to describe the experiment performed with the lubricant member of the preferred embodiment of the invention.
Figure 4B:
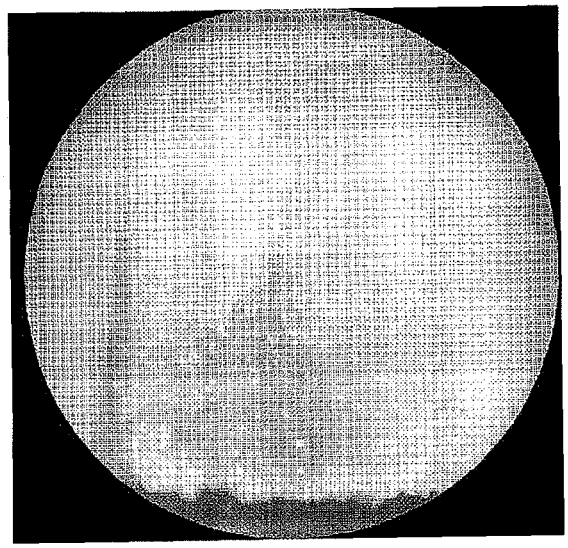
Figure 4C:
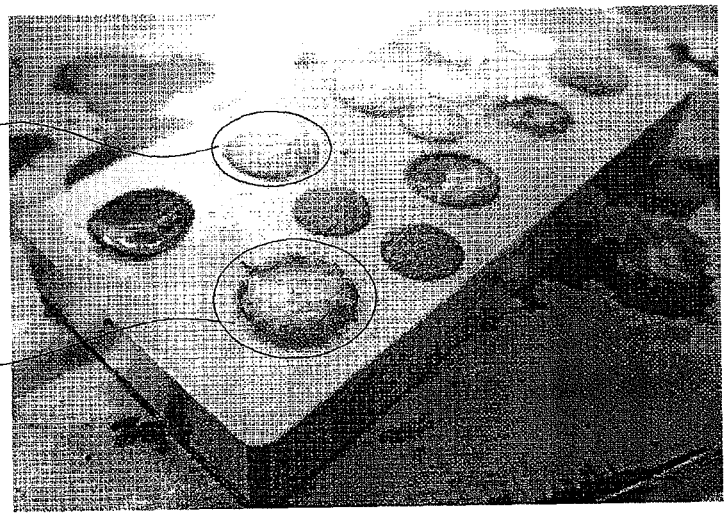

| | Nylon 6 (wt %) | High Molecular Weight Polyethylene (wt %) | Workability | Heat Resistance | Image |
|---|---|---|---|---|---|
| Example 1 | 40.0 | 0 | poor | — | FIG. 3A |
| Example 2 | 39.0 | 1.0 | poor | — | |
| Example 3 | 38.5 | 1.5 | Fairly poor | Good | FIG. 3B |
| Example 4 | 38.0 | 2.0 | Fairly good | Good | |
| Example 5 | 37.5 | 1.5 | Fairly good | Good | |
| Example 6 | 37.0 | 3.0 | Fairly good | Good | |
| Example 7 | 35.5 | 4.5 | Fairly good | Good | FIG. 3C |
| Example 8 | 34.5 | 5.5 | Good | Good | |
| Example 9 | 32.5 | 7.5 | Good | Good | FIGS. 4A and 4B |
| Example 10 | 30.0 | 10.0 | Good | Good | |
| Example 11 | 29.0 | 11.0 | Good | Fairly good | |
| Example 12 | 28.0 | 12.0 | Good | Fairly good | |
| Example 13 | 27.0 | 13.0 | Good | Fairly good | |
| Example 14 | 26.5 | 13.5 | Good | Fairly poor | FIG. 4C |
| Example 15 | 26.0 | 14.0 | Good | Poor | |
| Example 16 | 25.0 | 15.0 | Good | Poor | |
| Example 17 | 23.5 | 16.5 | Good | poor | |

Table 1 shows results of a test examining the workability and the heat resistance of the lubricant members 1 of Examples 1 to 17. The lubricant members 1 of Examples 1 to 17 had the same amount (60 wt %) of the lubricant oil (i.e., the mixture of poly-α-olefin and ester), but differed from one another in the amounts of the polyamide resin (Nylon 6) and the ultrahigh molecular weight polyethylene (MIPERON®) mixed in the corresponding lubricant members 1. For each lubricant member thus formed, the heat resistance was assessed on the base of the result of an actual sliding test done by burying cut pieces of the lubricant member in a sliding surface.

In Example 1, as FIG. 3A shows, Nylon 6 crystallized separately from the lubricant oil. As a result, the lubricant member 1 was unable to be shaped like a stick (a column). The crystal portions of Nylon 6 were densely crystallized and became hard. So, it was impossible to cut the lubricant member 1 in the diametrical direction (D) by using, for example, a cutter knife.

In Example 2, the inclusion of 1.0 wt % of the ultrahigh molecular weight polyethylene made it possible to shape the lubricant member 1 like a stick. However, the portion of the film 2 made of Nylon 6 (see FIG. 1B) was too thick to cut the lubricant member 1 in the diametrical direction (D) by using, for example, a cutter knife. For each of Examples 1 and 2, the heat resistance was unable to be examined, because the lubricant member 1 was not able to be cut.

In Example 3, although 1.5 wt % of the ultrahigh molecular weight polyethylene was included, the content of Nylon 6 was so much that the lubricant member 1 was able to be cut in the diametrical direction (D) in some portions, but not in other portions, depending on the crystal state of Nylon 6 as shown in FIG. 3B. In addition, as FIG. 3B shows, shrinkage cavities were formed in the central portion of the lubricant member 1. That is supposedly because the content of the ultrahigh molecular weight polyethylene was too small to inhibit the ultrahigh molecular weight polyethylene from forming a single crystal. Note that since the content of Nylon 6 was large enough, the lubricant member 1 kept its shape after the sliding test, and its heat resistance was accordingly satisfactory.

In Examples 4 to 7, the content of the ultrahigh molecular weight polyethylene was in a range of 2.0 wt % to 4.5 wt %, and the lubricant member 1 was able to be cut in the diametrical direction (D) at any position of the lubricant member. In addition, since the content of Nylon 6 was large enough, the lubricant member 1 kept its shape after the sliding test, and its heat resistance was accordingly satisfactory.

In each of Examples 8 to Example 10, the content of the ultrahigh molecular weight polyethylene was increased to a range of 5.5 wt % to 10.0 wt %. As FIG. 4A shows, the film 2 of Nylon 6 was adequately thin, and the lubricant member 1 was able to be cut in the diametrical direction (D) at any position. That is to say, the cutting-workability was improved. In addition, the content of Nylon 6 raised no problem because: the lubricant member kept its shape after the sliding test; and the heat resistance was accordingly satisfactory. Note that, as FIG. 4B shows, fibrous crystals of the polyamide resin and those of the ultrahigh molecular weight polyethylene were observed to be formed at the inner side of the film 2 of the lubricant member 1, and pores 3 with appropriate sizes existed there.

In each of Examples 11 to 13, the content of the ultrahigh molecular weight polyethylene ranged from 11.0 wt % to 13.0 wt %. The lubricant member 1 thus formed was able to be cut in the diametrical direction (D) at any position, and the cutting-workability was enhanced. Despite the increased amount of the ultrahigh molecular weight polyethylene, the lubricant member kept its shape after the sliding test, and the heat resistance was accordingly satisfactory. Incidentally, an amount of ultrahigh molecular weight polyethylene that flowed out of the lubricant member after the sliding test was larger in Examples 11 to 13 than in Examples 8 to 10, and a depressed area was formed in the central region of the lubricant member 1 in each of Examples 11 to 13. However, this raised no problem.

In Example 14, the content of the ultrahigh molecular weight polyethylene was 13.5 wt %. The lubricant member 1 was able to be cut in the diametrical direction (D) at any position, and the cutting-workability was enhanced. On the other hand, an amount of ultrahigh molecular weight polyethylene that flowed out of the lubricant member after the sliding test was larger. A depressed area was formed in the central region of the piece of the lubricant member 1 which is indicated by Circle A in FIG. 4C, and a bulging area was formed in the central region of the piece of the lubricant member 1 which is indicated by Circle B in FIG. 4C. The depressed area and the bulging area made the lubricant member assume a shape which impaired the sliding performance, and the lubricant member 1 was poor at the heat resistance.

In each of Examples 15 to 17, the content of the ultrahigh molecular weight polyethylene ranged from 14.0 wt % to 16.5 wt %. The lubricant member 1 was able to be cut in the diametrical direction (D) at any position, and the cutting-workability was enhanced. On the other hand, an amount of ultrahigh molecular weight polyethylene that flowed out of the lubricant member after the sliding test was much larger in Examples 15 to 17 than in the case of Example 14. The lubricant member 1 assumed a shape that impaired the sliding performance, and the lubricant member 1 was poor at the heat resistance.

The experiment results of Examples 1 to 17 proves that if the content of the ultrahigh molecular weight polyethylene ranges from 2.0 wt % to 13.0 wt %, the lubricant member 1 with adequate workability and heat resistance can be formed. Conversely, it is proved that: if the content of the ultrahigh molecular weight polyethylene is less than 2.0 wt %, the lubricant member is poor at the workability, and it is accordingly difficult to form a lubricant member having the desired characteristics; and if the content of the ultrahigh molecular weight polyethylene is greater than 13.0 wt %, the lubricant member is poor at the heat resistance, and it is accordingly difficult to form a lubricant member having the desired characteristics as well.

Note that although the embodiment have been described taking the case where the film 2 of the lubricant member 1 is single-layered, the embodiment is not limited to this case. For example, the film 2 may have multiple layers, for example, by adjusting the cooling temperature, the cooling method and the like. As described earlier, a thick layer of the film 2 impairs the cutting-workability of the lubricant member 1. Hence, any change can be made to the design with the mechanical strength and the workability of the lubricant member 1 taken into consideration. In addition, various other changes can be made without departing from the essence of the invention.

Figure 5A:
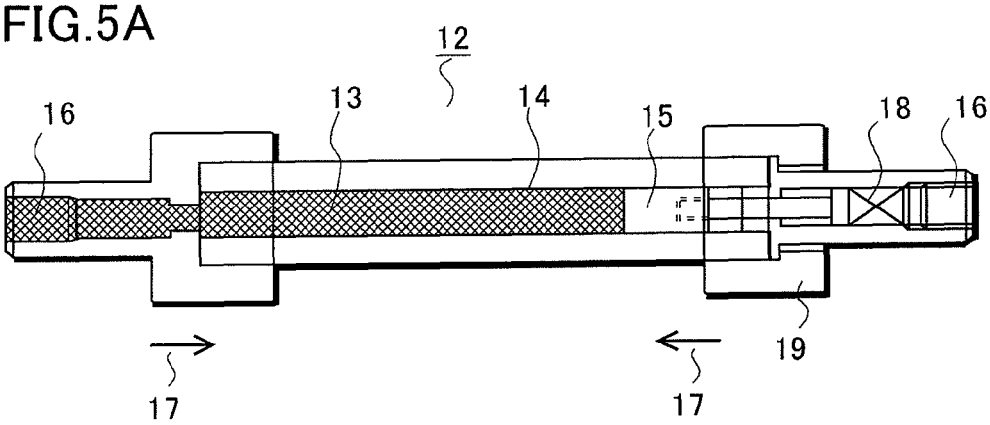
FIGS. 5A to 5C are sectional views to describe the lubricant member of the preferred embodiment of the invention.
Figure 5B:
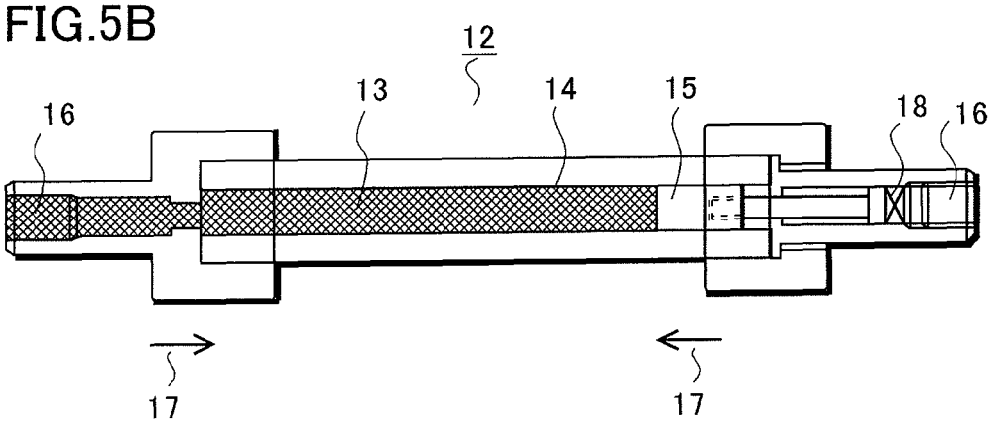
Figure 5C:
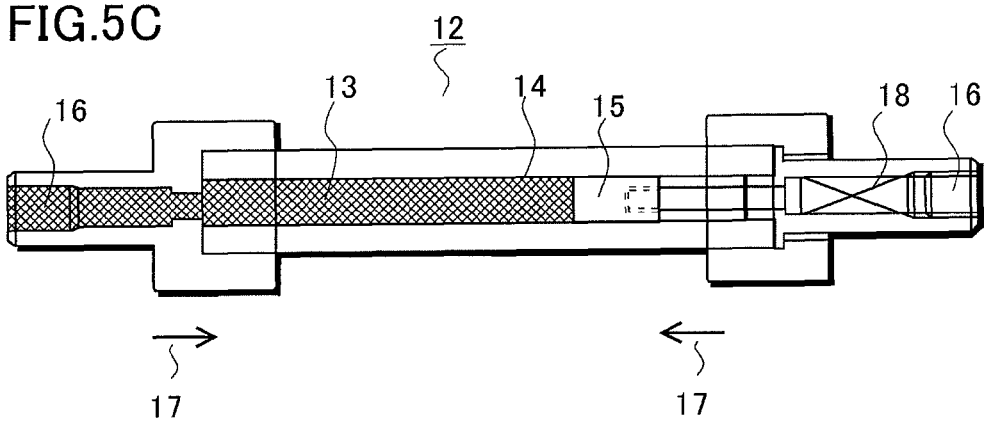
Figure 6:
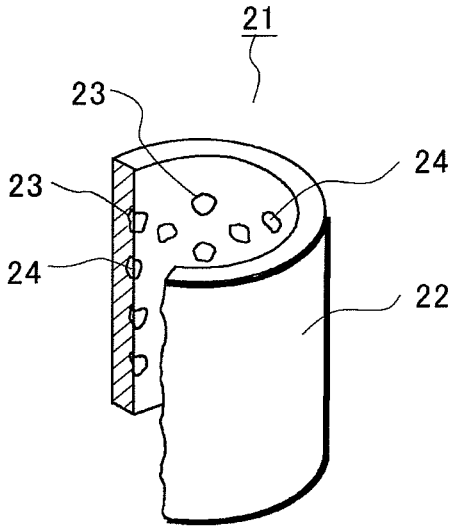
FIG. 6 is a perspective view to describe an oilless bearing of a conventional embodiment.
Figure 7:
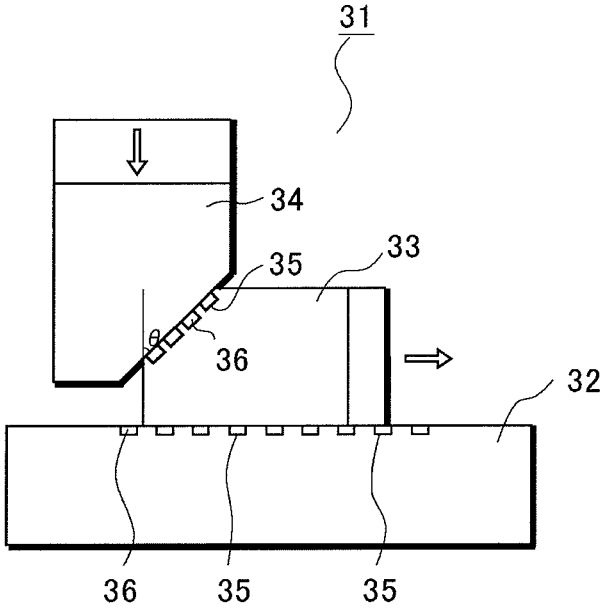
FIG. 7 is a sectional view to describe a set of dies with a solid lubricant buried in the set of dies of another conventional embodiment.

Next, description is given of another preferred embodiment of the invention, that is, a method of manufacturing a lubricant composition. FIGS. 5A to 5C are sectional views to describe the method of manufacturing a lubricant member of the embodiment.

Granulated granular of Nylon 6 is used as the thermoplastic resin. Granulated granular of MIPERON® is used as the ultrahigh molecular weight polyethylene. A mixture of poly-α-olefin and ester is used as the lubricant oil. All of these components are mixed together at the ordinary temperature to form a gel mixture. The air contained in the mixture is removed by agitating the mixture. Then, the resultant mixture 13 is filled into a cavity 14 of a die 12, and then the cavity 14 is shielded, as FIG. 5A shows. Note that the cavity 14 has a cylindrical shape.

In this respect, a pusher mechanism 16 is connected to an open-close plug 15. The pusher mechanism 16 applies a certain pressure to the inside of the cavity 14 in the lengthwise direction (L) of the cavity 14, as indicated by arrows 17 in FIG. 5A. The pusher mechanism 16 includes an elastic mechanism 18 formed from a spring and the like. Thus, the open-close plug 15 moves in the lengthwise direction (L) of the cavity 14 in accordance with the state of the mixture 13. Note that a fastener-screw mechanism 19 fixes the position to which the pusher mechanism 16 is attached, but both the open-close plug 15 and the elastic mechanism 18 are movable.

Thereafter, the die 12 is placed in a furnace, and the die 12 is heated up to a temperature at which the mixture 13 in the cavity 14 is melted (i.e., at least to a temperature equal to or higher than the melting point of Nylon 6).

FIG. 5B shows the state of the die 12 being heated. After heated up to the temperature equal to or above the melting point of the Nylon 6, the mixture 13 is cured in the furnace for approximately 45 minutes to 60 minutes. While being cured, the mixture 13 expands to make the open-close plug 15 push the elastic mechanism 18, and the open-close plug 15 moves towards the outer side of the cavity 14. It should be noted that even in this state, a certain pressure is applied by the pusher mechanism 16 to the mixture 13, as indicated by the arrows 17.

Then, the die 12 is taken out of the furnace, and is left in the workroom to be, for example, air-cooled down to room temperature. FIG. 5C shows the die 12 thus cooled down. As the mixture 13 shrinks, the open-close plug 15 is pushed by the elastic mechanism 18 to move towards the inner side of the cavity 14. During this time, a pressure is applied to the mixture 13 by the pusher mechanism 16 and the elastic mechanism 18. Then, the lubricant member is removed from the die 12, and the lubricant member is completed.

One may consider that, as described above, the fibrous crystals of the polyamide resin and those of the ultrahigh molecular weight polyethylene extend mainly in the lengthwise direction (L) of the lubricant member 1 and the multiple pores 3 are formed, because, as described above, both the heating and the cooling of the die 12 are performed with the pressure applied to the mixture 13 in the die 12 in the lengthwise direction (L) of the cavity 14. In addition, each of the pores 3 tends to have a shape extending in the lengthwise direction (L) of the lubricant member 1, so that the lubricant member 1 can have a longer service life.

In addition, like the cavity 14 which has a cylindrical shape, the die 12 has a columnar shape that facilitates the dissipation of heat. Hence, the cooling of the mixture 13 in the cavity 14 progresses from the outer side, in the diametrical direction (D). Consequently, the densely-crystallized film 2 of Nylon 6, which has the smooth and flexible surface, is formed in the outermost portion of the lubricant member 1. Thus, the film 2 realizes a structure which prevents the leakage of the lubricant oil from the side surface of the lubricant member 1 as effectively as possible, and which makes it easy for the lubricant oil to be supplied to the sliding surface.

In addition, because the open-close plug 15 is moved by the elastic mechanism 18 in accordance with the state of the mixture 13, the lubricant member 1 is securely formed into a columnar shape although the Nylon 6 shrinks while the Nylon 6 is hardened.

Note that, although the embodiment has been described taking the case where the die 12 is air-cooled in the workroom, the cooling method is not limited to this case. The cooling time may be shortened, for example, by air-cooling the die 12 in the workroom for a certain length of time; and thereafter cooling the resultant die 12 with warm water. That is to say, a step-by-step manner of cooling the die 12 can be employed as long as both a desirable extending direction of the crystals of the lubricant member 1 and a desirable structure of the pores 3 can be achieved as described earlier. In short, changes can be made to the design of the cooling method. In addition, various other changes can be made without departing from the essence of the invention.

The invention realizes the lubricant member, which is good at heat-resistance and durability while maintaining the certain lubricating property, because the thermoplastic resin that contains the lubricant oil and has the lubricating property is used.

In addition, the invention realizes the lubricant member whose shape is easy to keep, and which is good at supplying the lubricant oil in the lengthwise direction, because its external circumferential surfaces is coated with the thermoplastic resin which is in the densely-crystallized state.

Furthermore, the invention increases the amount of lubricant oil to be included in the lubricant member, and makes the lubricant member contains the lubricant oil more homogeneously, because: the thermoplastic resin is crystallized in the fibrous state more in the lengthwise direction than in the diametrical direction; and the multiple pores are accordingly faulted.

Moreover, the invention enhances the workability of the lubricant member while maintaining the mechanical strength of the lubricant member, because the lubricant member contains the 2 wt % to 13 wt % of ultrahigh molecular weight polyethylene.

Besides, the invention enhances the workability of the lubricant member when the lubricant member is used in the sliding surface, and makes it easier to place the lubricant member in the sliding surface, because the lubricant member is formed into the columnar shape.

Additionally, the invention forms the lubricant member that is processed in the stick-shaped shape, because the heat treatment is performed on the mixture placed in the cavity of the die under pressure applied in the lengthwise direction of the cavity.

In addition, the invention forms the lubricant member which dissipates heat homogeneously, and which has an excellent process shape, because the cavity of the die is shaped like a cylinder.

In addition, the invention forms the lubricant member which is long in the lengthwise direction, because the movement of the open-close plug of the die is adjusted by use of an elastic mechanism in accordance with the state of the mixture placed in the cavity.

What is claimed is:

1. A lubricant member molded into a stick-shaped body defined by an axial direction and a radial direction, comprising:

a lubricant oil;

an ultrahigh molecular weight polyethylene; and a thermoplastic resin having a melting point higher than the ultrahigh molecular weight polyethylene;

wherein the thermoplastic resin forms a crystallized portion in an outer portion of the stick-shaped body with respect to the radial direction and forms fibrous crystals in an inner portion of the stick-shaped body with respect to the radial direction so that a plurality of pores between the fibrous crystals contain the lubricant oil or crystallized bodies of the ultrahigh molecular weight polyethylene holding the lubricant oil, the inner portion has more porosity than the outer portion.

2. The lubricant member of claim 1, wherein the fibrous crystals are elongated in the axial direction of the stick-shaped body.

3. The lubricant member of claim 1, wherein the thermoplastic resin forms a plurality of layers coaxially stacked in the radial direction, the layers include the fibrous crystals so as to be elongated in the axial direction, and the fibrous crystals also exist between the layers so as to connect the layers.

4. The lubricant member of claim 3, wherein the stick-shaped body takes a form of a column, and the layers are arranged circularly along a side surface of the column.

5. The lubricant member of claim 1, wherein the stick-shaped body contains 2 wt % to 13 wt % of ultrahigh molecular weight polyethylene.

6. The lubricant member of claim 5, wherein an amount of the lubricant oil is greater than an amount of the thermoplastic resin and greater than an amount of the ultrahigh molecular weight polyethylene by weight.

7. The lubricant member of claim 1, wherein the thermoplastic resin is a polyamide resin.

* * * * *